US007295122B2

(12) United States Patent
Inoue

(10) Patent No.: US 7,295,122 B2
(45) Date of Patent: Nov. 13, 2007

(54) SIGNAL GENERATING DEVICE, METHOD THEREOF, AND APPARATUS HAVING THE SAME

(75) Inventor: Makoto Inoue, Tokyo (JP)

(73) Assignee: Sony Corporation (JP)

( * ) Notice: Subject to any disclaimer, the term of this patent is extended or adjusted under 35 U.S.C. 154(b) by 245 days.

(21) Appl. No.: 11/089,200

(22) Filed: Mar. 24, 2005

(65) Prior Publication Data

US 2005/0233860 A1 Oct. 20, 2005

(30) Foreign Application Priority Data

Apr. 15, 2004 (JP) ..... P2004-120748

(51) Int. Cl.
*G08B 23/00* (2006.01)

(52) U.S. Cl. ..... 340/573.1; 482/8

(58) Field of Classification Search ..... 340/573.1
See application file for complete search history.

(56) References Cited

U.S. PATENT DOCUMENTS

2005/0219055 A1* 10/2005 Takai et al. ..... 340/573.1

FOREIGN PATENT DOCUMENTS

| | | |
|---|---|---|
| JP | 06-000231 | 1/1994 |
| JP | 11-128392 | 5/1999 |
| JP | 2002-341865 | 11/2002 |

* cited by examiner

*Primary Examiner*—Benjamin C. Lee
*Assistant Examiner*—Travis R. Hunnings
(74) *Attorney, Agent, or Firm*—Lerner, David, Littenberg, Krumholz & Mentlik, LLP

(57) ABSTRACT

A signal generating device generates a signal capable of easily inviting a user's attention in every conceivable circumstance even in an environment subject to noise or vibration. The signal generating device includes a detection section detecting the motion of the user, a feature extraction section extracting the feature quantity from the value detected by the detection section, a signal generation section generating a signal corresponding to the feature quantity extracted by the feature extraction section, and a presentation section presenting the generated signal to the user.

22 Claims, 7 Drawing Sheets

SIGNAL GENERATING DEVICE, METHOD THEREOF, AND APPARATUS HAVING THE SAME

CROSS-REFERENCE TO RELATED APPLICATIONS

The present invention contains subject matter related to Japanese Patent Application JP 2004-120748 filed in the Japanese Patent Office on Apr. 15, 2004, the entire contents of which being incorporated herein by reference.

BACKGROUND OF THE INVENTION

1. Field of the Invention

The present invention relates to a signal generating device that generates a signal notifying a device user of a state change of the device, an event occurrence and the like and a mechanical apparatus having the signal generating device.

2. Description of the Related Art

Excessive speed warning for a car, wrong operation warning used in machinery for industrial use, overrun warning for control values, such as pressure or temperature, used in a manufacturing premise and the like must invite user's attention without fail even under a noisy environment. In addition to the above warnings, for example, in the case of a mobile phone, it is preferable that information for notifying a user of a state change of a device or new arrival of information such as incoming call or mail reception easily invite user's attention even under a noisy environment, for example, in and out of a mobile object such as a motor bus, a train, a car, or in a public space.

It is assumed that wrong operation warning or mail arrival notification in a personal computer is delivered to the user in a form of "sound". In this case, the warning or notification sound cannot be turned up in order to maintain silence in an office or the like. On the other hand, if a use environment is noisy, the warning or notification sound is output at a large volume comparing favorably with surrounding noise, operational noise of machine to try to invite the user's attention. However, a large volume of warning or notification sound becomes new "noise" for other users (operators or workers).

Further, in the case of a mobile electronic device, warning or notification sound is generated even when the device user is in motion, in a walking state, or the like as long as the device is running. Therefore, the warning or notification sound must be easily perceived by the user even when the user is in an environment subject to noise or vibration.

That is, generation of the warning or notification sound that can easily invite the user's attention even under whatever circumstances is demanded. For example, Jpn. Pat. Appln. Laid-Open Publication No. 11-249673 discloses a technique of applying amplitude modulation using envelops curve function having a pulse-like rhythm to a carrier within an audible range so as to output it and combining two or more of the following elements: the vibration number of the carrier; the amplitude of the carrier; the pulse speed of envelops curve function used in amplitude modulation; and the pulse width of envelops curve function used in amplitude modulation, to synchronously change the carrier, thereby generating an warning that can be easily distinguished even under a noisy environment.

The above technique of Jpn. Pat. Appln. Laid-Open Publication No. 11-249673 intends to make the user easily distinguish the warning sound by synchronously changing the rise and fall or volume of the warning sound. Even in this case, however, the warning sound may not reliably be perceived by the user if he or she concentrates on a task or the like, as in the case with an ordinary warning sound. Further, since being easily distinguished not only the user whose attention needs to be attracted but also other users surrounding the target user, the warning sound according to this technique is not adequate in the situation where the warning or notification needs to be directed only to a specified user under an environment in which a plurality of users use a plurality of apparatuses, leading to confusion of the warning or notification sound emitted from the plurality of apparatuses.

SUMMARY OF THE INVENTION

It is desirable to provide a signal generating device capable of generating an warning or notification that can invite user's attention in every conceivable circumstance such as in an environment subject to noise, vibration or the like and that can be easily perceived by the user even when he or she is in motion.

To achieve the above object, according to the present invention, there is provided a signal generating device comprising: a detection means for detecting the motion of the user; a feature extraction means for extracting the feature quantity from the value detected by the detection means; a signal generation means for generating a signal corresponding to the feature quantity extracted by the feature extraction means; and a presentation means for presenting the generated signal to the user.

The signal generation means generates a signal synchronous with the feature quantity extracted by the feature extraction means and inserts a signal at regular timings into the generated signal or removes a signal at regular timings from the generated signal. Further, the signal generation means may insert or remove a signal at irregular timings into/from a signal synchronous with the feature of the motion. The signal generation means also can generate a signal asynchronous with or a signal partly synchronous and partly asynchronous with the feature quantity extracted by the feature extraction means. The signals thus generated are selectively used depending on the state of an apparatus in which the signal generating device is incorporated.

When the signal generating device is applied to a portable apparatus that the user can be equipped with when used, the detection means is attached to a part of the user's body, and the signal generation means generates a signal synchronous and/or asynchronous with the feature quantity while the user is walking or running, the feature quantity being detected by the feature extraction means. As the part to which the detection means is attached, a body part that operates a mechanical apparatus having the signal generating device can be taken. Further, the detection means may be provided in an operation input section of a mechanical apparatus having the signal generating device, for which the user performs an input operation. Examples of the presentation means include a light emitting means, voice output means, and vibration generation means.

To achieve the above object, according to the present invention, there is provided a signal generating method comprising: a detection step of detecting the motion of the user; a feature extraction step of extracting the motion's feature quantity from the value detected in the detection step; a signal generation step of generating a signal corresponding to the feature quantity extracted in the feature extraction step; and a presentation step of presenting the generated signal to the user.

To achieve the above object, according to the present invention, there is provided a mechanical apparatus having an operation input means for which a user performs an input operation and a control means for controlling the operation of the apparatus based on an instruction from the user that has been input through the operation input means, comprising: a detection means for detecting the motion of the user; a feature extraction means for extracting the feature quantity from the value detected by the detection means; a signal generation means for generating a signal corresponding to the feature quantity extracted by the feature extraction means; and a presentation means for presenting the generated signal to the user, wherein when an event to be notified to the user occurs, the control means allows the presentation means to present the occurrence of the event to the user using the signal generated by the signal generation means.

The detection means for detecting the motion of the user may be provided in an operation input means and may detect the motion of the user indirectly by detecting the user's input operation for the operation input means.

The signal generating means generates a signal synchronous with, a signal asynchronous with, and a signal partly synchronous and partly asynchronous with the feature quantity extracted by the feature extraction means. When an event to be notified to the user occurs, the control means uses the generated signal to present the occurrence of the event to the user. The signal synchronous with, the signal asynchronous with, and the signal partly synchronous and partly asynchronous with the feature quantity extracted by the feature extraction means are selectively used depending on the types of the event that occurs in the mechanical apparatus.

According to the present invention, it is possible to generate a warning or notification that can easily invite user's attention even in an environment subject to noise or vibration, that does not disturb the persons other than the user just using the apparatus, and that is easily perceived by the user even when the user is in motion. When a signal synchronous with the motion of the user or the motion of the mechanical apparatus that the user operates is presented, the user receives the signal synchronous with the motion of himself or herself, so that he or she is reliably aware of the signal under a noisy environment, during movement, or during work. On the other hand, when a signal partly synchronous and partly asynchronous with the motion of the user or the motion of the mechanical apparatus that the user operates is presented, the user senses discomfort at the signal, so that he or she is reliably aware of the signal under a noisy environment, during movement, or during work.

DETAILED DESCRIPTION OF THE PREFERRED EMBODIMENTS

A signal generating device shown as an embodiment of the present invention is a signal generating device that detects the motion of a user using a sensor, extracts the feature of the detected motion, and generates a signal corresponding to the feature, and is used by incorporating it in a general electronic apparatus, mechanical apparatus, or the like. When an event to be notified to a user, such as "state change of the machine", "warning", or "notification", occurs in the electronic apparatus or mechanical apparatus, the signal generating device according to the present invention uses a signal generated in correspondence with the extracted feature of the motion to notify the user of the occurrence of the event. Examples of the motion of the user include a body motion during walking or breathing, a body motion during operation of a car, airplane, craft, or the like and a motion during typing on the keyboard of a personal computer.

When an event occurs in the electronic apparatus or mechanical apparatus, a signal synchronous or asynchronous with the user's motion is emitted. The signal synchronous or asynchronous with the user's motion induces comfortable or uncomfortable feeling of the user, so that it is possible to reliably invite user's attention even when the user is in a situation where the warning or notification is not easily perceived by the user, for example, in a noisy environment, or in a situation where the user concentrates on something or the like.

Figure 1:
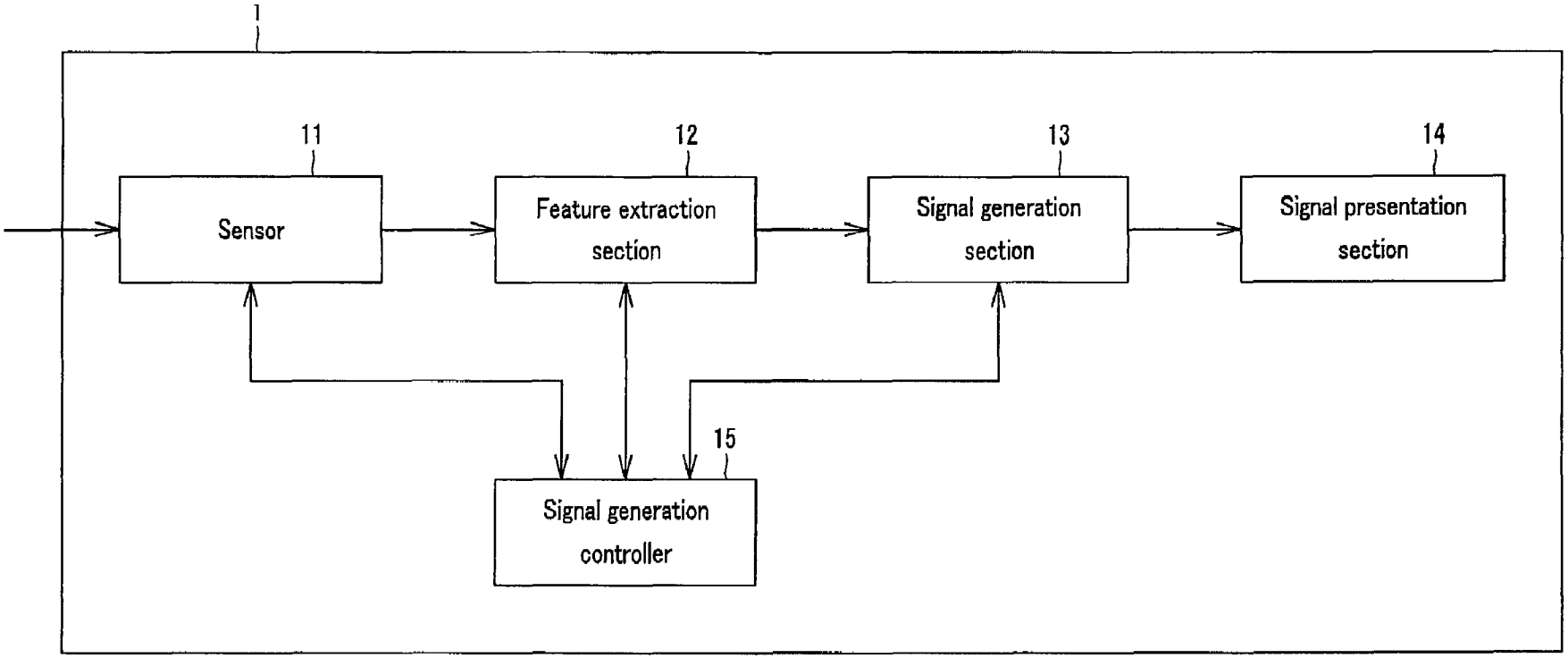
FIG. 1 is a configuration diagram for explaining a signal generating device taken as a concrete example of the present invention.

A signal generating device according to the embodiment of the present invention will be described below in detail with reference to the accompanying drawings. As shown in FIG. 1, the signal generating device 1 includes a sensor 11 that detects the motion of a user, a feature extraction section 12 that extracts the feature of the motion from the detection value of the sensor, a signal generation section 13 that generates a signal corresponding to the feature, a signal presentation section 14 that presents the generated signal to the user, and a signal generation controller 15 that controls the above components.

The sensor 11 should detect the motion of the user and is attached to a part of the user's body, clothes of the user, accessories, portable electronic apparatus or the like. As the sensor 11, it is possible to use a vibration sensor, an acceleration sensor, a displacement sensor, a pressure sensor, and the like. These sensors are selectively used depending on the attachment point. Further, the sensor 11 may be attached to the operation panel of the electronic apparatus or mechanical apparatus that the user directly operates. In this case, the sensor 11 detects the user's contact to the sensor 11 or motion of the user at the operation time. Likewise, in the case where the sensor 11 is attached to the apparatus, it is possible to use a vibration sensor, an acceleration sensor, a displacement sensor, a pressure sensor, and the like as the sensor 11. When an operation section uses button-type switches, slide-type switches, lever-type switches, it is possible for the sensor 11 to detect the motion of the user based on the user's switch operation. For example, in the case where an input section that is directly operated by the user, like a keyboard used as an input means of a personal computer, can itself detect the motion of the user at the operation time, a special sensor need not be provided.

The feature extraction section 12 detects the feature quantity of the signal detected by the sensor 11. The configuration of the feature extraction section 12 should be selected depending on the configuration of the sensor 11 or index to be detected. When the detection value of the sensor 11 is obtained as a pulse, it is possible to treat the detection value as the feature quantity representing the feature of the motion. When the detection value is obtained intermittently or continuously, an HPF (High Pass Filter), an LPF (Low Pass Filter), or the like is used to extract the feature component.

The signal generation section 13 generates a signal based on the feature quantity received from the feature extraction section 12. The signal generation section 13 can generate a signal in the following ways: generate a signal synchronous with the feature quantity (including the case where the feature quantity that has been detected in the feature extraction section 12 is directly output); generate a signal asynchronous with the feature of the motion; generate a signal partly synchronous and partly asynchronous with the feature quantity; and the like. The feature quantity of the sensor data extracted in the feature extraction section 12 and the signal to be generated based on the feature quantity will be described later in detail with reference to FIG. 2.

The signal generation controller 15 uses the signal that the signal generation section has generated when an event to be notified to the user occurs in the electronic apparatus or mechanical apparatus having the signal generating device 1. That is, at the occurrence of an event, the signal generation controller 15 outputs a signal at timings synchronous with the motion of the user, outputs a signal at timings slightly asynchronous with the motion of the user, or outputs, by mixture, a signal synchronous with the motion of the user and a signal asynchronous with the motion of the user. "Event to be notified" includes, for example, an event that must be perceived by the user as an attention or warning, and an event merely informing the user of a notification. The object and urgency of the event notification differ between the two. In the present embodiment, these events dissimilar in character are classified into "warning" and "notification".

The signal presentation section 14 allows the user to perceive the signal generated by the signal generation section 13. As a means for exciting a sensory organ of the user to allow him or her to perceive the occurrence of event, a light emitting element such as an LED that excites the visual sense by light, a buzzer, a bell, and a speaker that excite the auditory sense by sound, and a vibrator that excites the tactile sense by vibration can be used. The configuration of the signal presentation section 14 can freely be selected depending on the characteristics of the apparatus or machine in which the signal generating device 1 is incorporated or use state thereof.

The signal that the signal generation section 13 generates based on the feature quantity of the sensor data extracted in the feature extraction section 12 will next be described with reference to FIGS. 2A to 2E. In each drawing, the abscissa denotes time, and the ordinate denotes amplitude or signal intensity. It should be noted that the amplitude may be the digitized one that merely represents the presence or absence of beat (feature point) extracted by the feature extraction section 12. Although FIG. 2A shows that the motion of the user occurs at a constant frequency for simplicity of explanation, the frequency of the motion is not a constant value but changes actually.

Figures 2A, 2B, 2C, 2D, 2E:
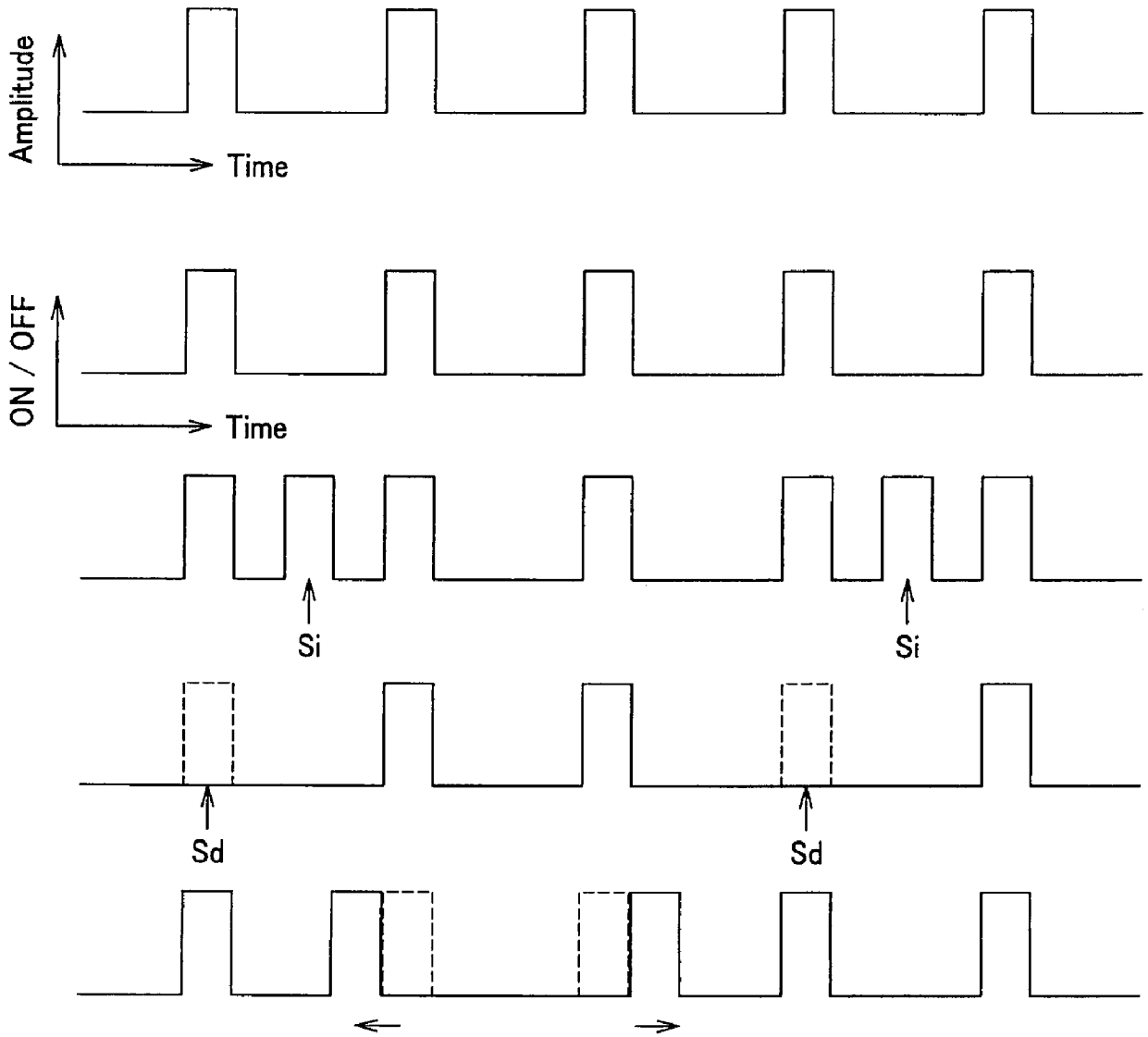
FIGS. 2A to 2E are views each explaining a feature quantity of sensor data extracted in a feature extraction section of the signal generating device and a signal generated based on the feature quantity.

FIG. 2A shows the feature quantity that has been extracted from the sensor data detected in the sensor 11. FIG. 2B shows the signal synchronous with the feature quantity that has been extracted by the feature extraction section 12. FIG. 2B is an example of the case where the signal generation section 13 outputs the feature quantity that has been extracted in the feature extraction section 12 as a signal without change. The signal generation section 13 turns ON the output in synchronization with the feature extracted in the sensor 11.

FIG. 2C shows the signal that the signal generation section 13 has generated by inserting a signal at irregular timings into the feature quantity extracted by the feature extraction section 12. The signal Si is inserted at timings denoted by arrows. FIG. 2D shows the signal that the signal generation section 13 has generated by removing a signal at irregular timings from the feature quantity extracted by the feature extraction section 12. The signal generation section 13 turns OFF the output at timings denoted by arrows when a signal Sd corresponding to the extracted feature quantity has been removed. The signal insertion or removal timing can be determined at random by, for example, a pseudorandom number.

FIG. 2E shows the signal that the signal generation section 13 has generated in such a manner that the signal partly becomes asynchronous with the feature quantity extracted by the feature extraction section 12. In order to generate a signal partly asynchronous with the feature quantity, the signal generation section 13 applies modulation to the signal corresponding to the extracted feature quantity of the user's motion to thereby partly hasten or delay the timing at random or change the intensity of the signal. In FIG. 2E, the feature quantity originally extracted is depicted by the dotted line and the signal to be output at timings asynchronous with the feature quantity is depicted by the solid line. Which feature point is changed, whether the timing is hastened or delayed, or how much the timing is hastened or delayed can be determined, like the above case, at random by, for example, a pseudorandom number.

It is only necessary to delay the feature point in the process of delaying the timing of the feature point. However, prediction is needed for hastening the feature point. For example, a process of predicting the next motion timing from the feature quantity that has been extracted at that time, inserting a signal at a time earlier than the predicted timing and removing the feature point that has actually been detected in the next timing is performed.

As described above, the signal generation section 13 can generate the signal synchronous with the feature quantity of the user's motion extracted from the sensor data detected by the sensor 11 or the signal partly synchronous and asynchronous with the feature quantity. The signal thus generated easily invites the user's attention and does not disturb other persons surrounding the user and can therefore be effectively used as a notification signal when the event to be notified to the user occurs in the electronic apparatus or mechanical apparatus.

For example, the signal generation section 13 detects a body motion during walking (or running) or breathing, a body motion during operation of a car, airplane, craft, or the like and a motion during typing on the keyboard of a personal computer, extracts the rhythm of the motion, peculiarity, or the like as a feature quantity, and generates an electronic sound synchronous with the feature quantity or a signal asynchronous with the feature quantity. When an event that the electronic apparatus or mechanical apparatus wants to notify the user occurs, the generated signal is presented to the user.

That is, the electronic apparatus or mechanical apparatus generates an electronic sound or the like synchronous with the motion of the user. Further, the electronic apparatus or mechanical apparatus generates an electronic sound or the like slightly asynchronous with the motion of the user. In the former case, the sound is emitted in synchronization with the operational motion of the user, so that the user's attention can easily be attracted. In the latter case, the sound is emitted at timings irrespective of the operational motion of the user, so that the user senses a discomfort at the sound, which also invites the user's attention. In the present embodiment, the signal of the former case is used for "notification", and the signal of the latter case is used for "warning".

In the following, examples of the electronic apparatus or mechanical apparatus having the signal generating device 1 will be described. At first, an example in which the signal generating device 1 is applied to the alarm of a running timer will be described with reference to FIGS. 3 and 4. The running timer is an apparatus that can notify the user of the end time of running (or walking). The user previously sets a desired running time, end time, or the like in the running timer.

Figure 4:
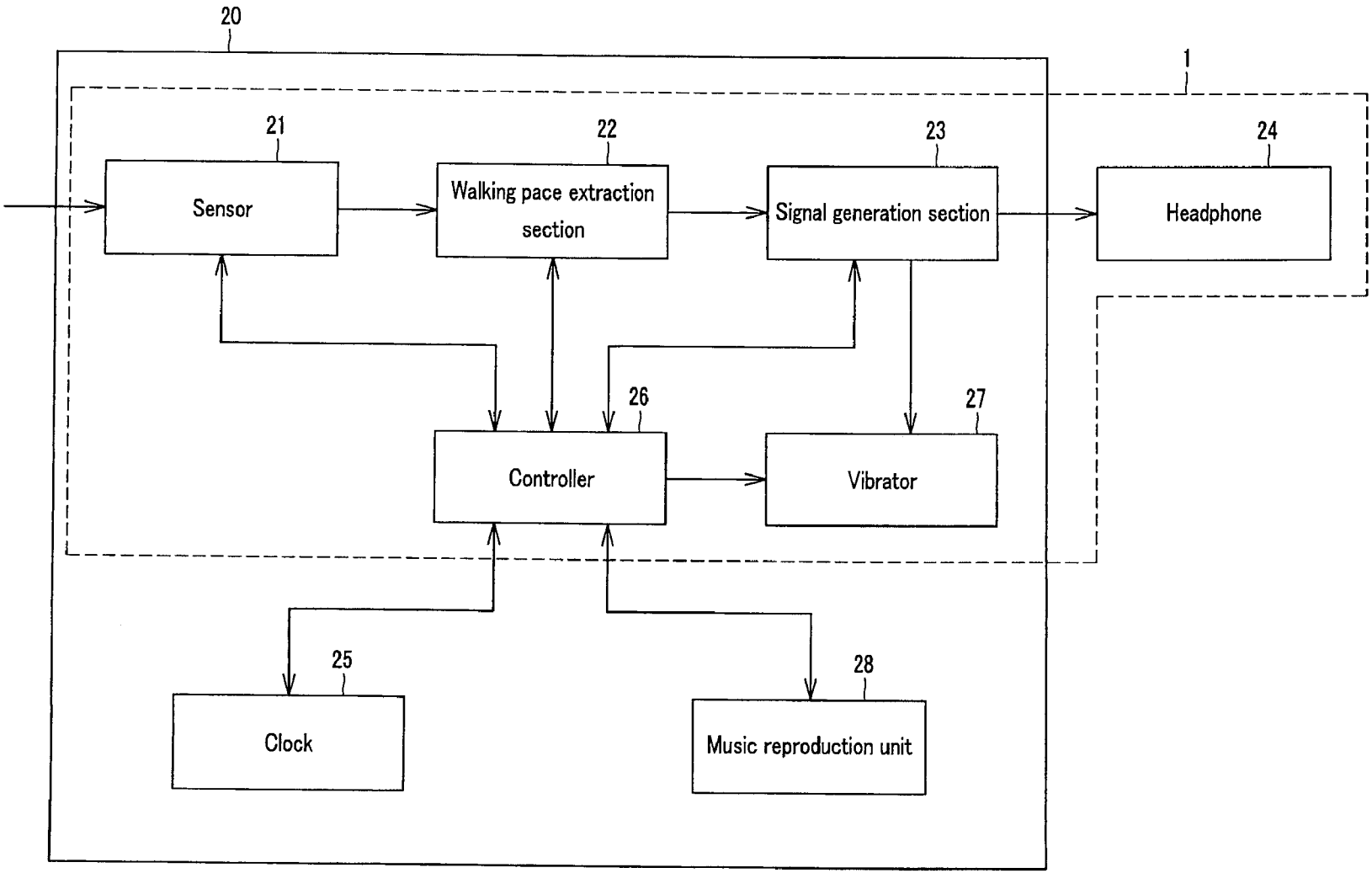
FIG. 4 is a configuration diagram for explaining the running timer having the signal generating device.

The running timer 20 includes a sensor 21 that detects the vertical motion of the user, a walking pace extraction section 22 that extracts walking pace from the data detected by the sensor 21, a signal generation section 23 that generates a signal based on the walking pace, a headphone 24 that delivers the generated signal to the user as sound, a clock 25 that counts running time, end time, or the like, and a controller 26 that control the above components. In FIG. 4, the configuration of the signal generating device 1 is surrounded by the dotted line. Further, the running timer 20 may include a vibrator 27 as well as the headphone 24 as a signal presentation means. Further, the running timer 20 may include a music reproduction unit 28 for reproducing the music. Examples of the music reproduction unit 28 include a driver for reproducing a detachable recording medium, such as a CD (Compact Disc), MD (Mini Disc™), or the like, or a driver for reproducing a detachable semiconductor memory.

Figure 3:
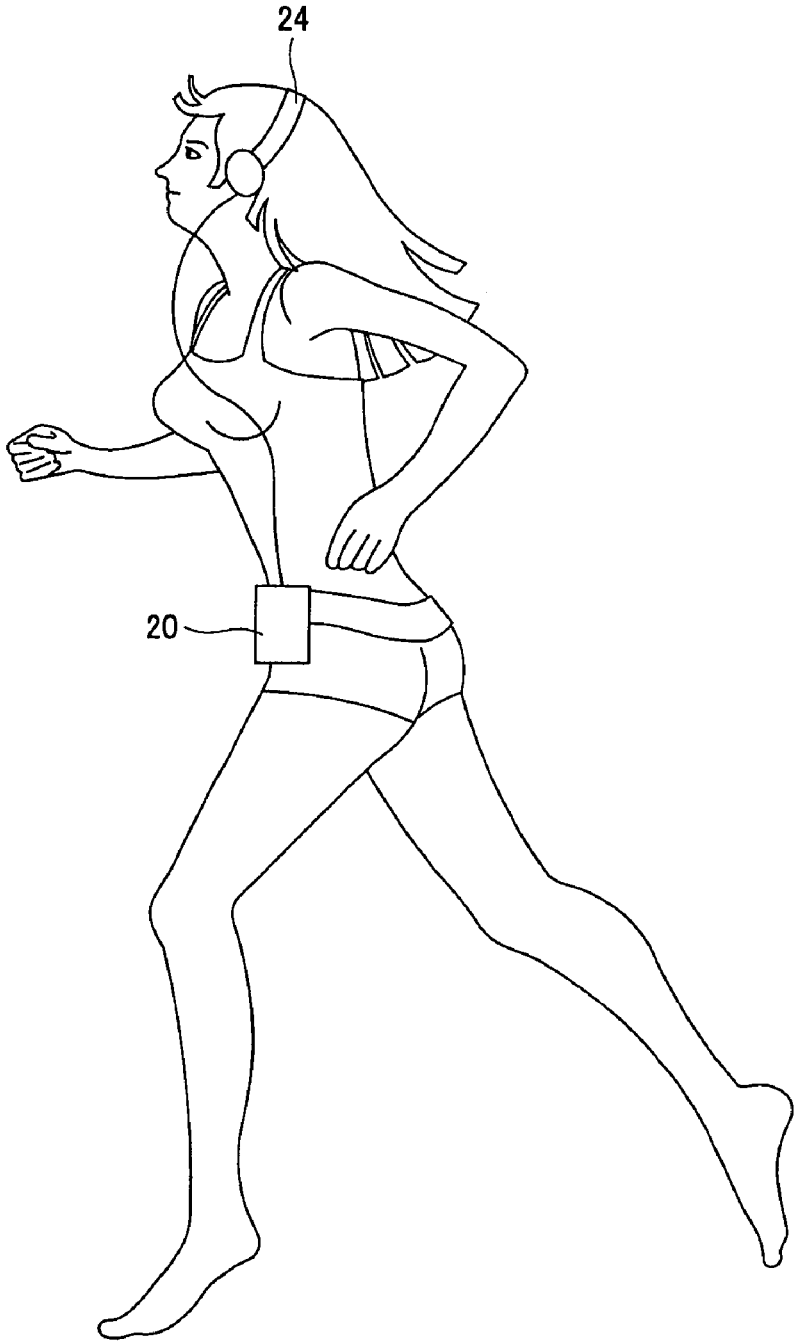
FIG. 3 is a view schematically explaining a running timer having the signal generating device.

As shown in FIG. 3, a main body (except for the headphone 24) is attached to the waist of the user through a belt or the like. The alarm sound with a rhythm synchronous with the rhythm of the vertical motion of the user (that is, the running rhythm) detected by the sensor 21 or the alarm sound with a rhythm partly synchronous and partly asynchronous with the rhythm of the vertical motion of the user is generated in the running timer 20. When receiving a signal representing a passage of a predetermined running time from the clock 25, the controller 26 outputs the generated alarm sound through the headphone 24 to notify the user that it is time to finish running. The user receives alarm sound or vibration synchronous with the running pace.

Next, an example in which the signal generating device 1 is applied to an excessive speed warning system for a car will be described with reference to FIGS. 5 and 6. As shown in FIG. 6, an excessive speed warning apparatus 30 includes a sensor 31 that is incorporated in a handle and detects driver's steering behavior, a pattern extraction section 32 that extracts a pattern of minute motion in the driver's steering behavior from the data detected by the sensor 31, a signal generation section 33 that generates a signal based on the extracted pattern of minute motion, a car speaker 34 that delivers the generated signal to the user as sound, and a controller 35 that controls the above components. In FIG. 6, the configuration of the signal generating device 1 is surrounded by the dotted line.

The pattern of minute motion detected by the pattern extraction section 32 is not an explicit steering behavior for turning left or right, or shifting lanes, but indicates "handle wobble" that the driver is not aware of, the "handle wobble" being detected within "structure allowance" of the handle at the stable running time, for example, on the express way.

A running speed detector 36 is attached to an axle or the like and detects a running speed. A controller 35 receives the speed value detected by the running speed detector 36 and presents an alarm sound to the driver through the car speaker 34.

Figure 5:
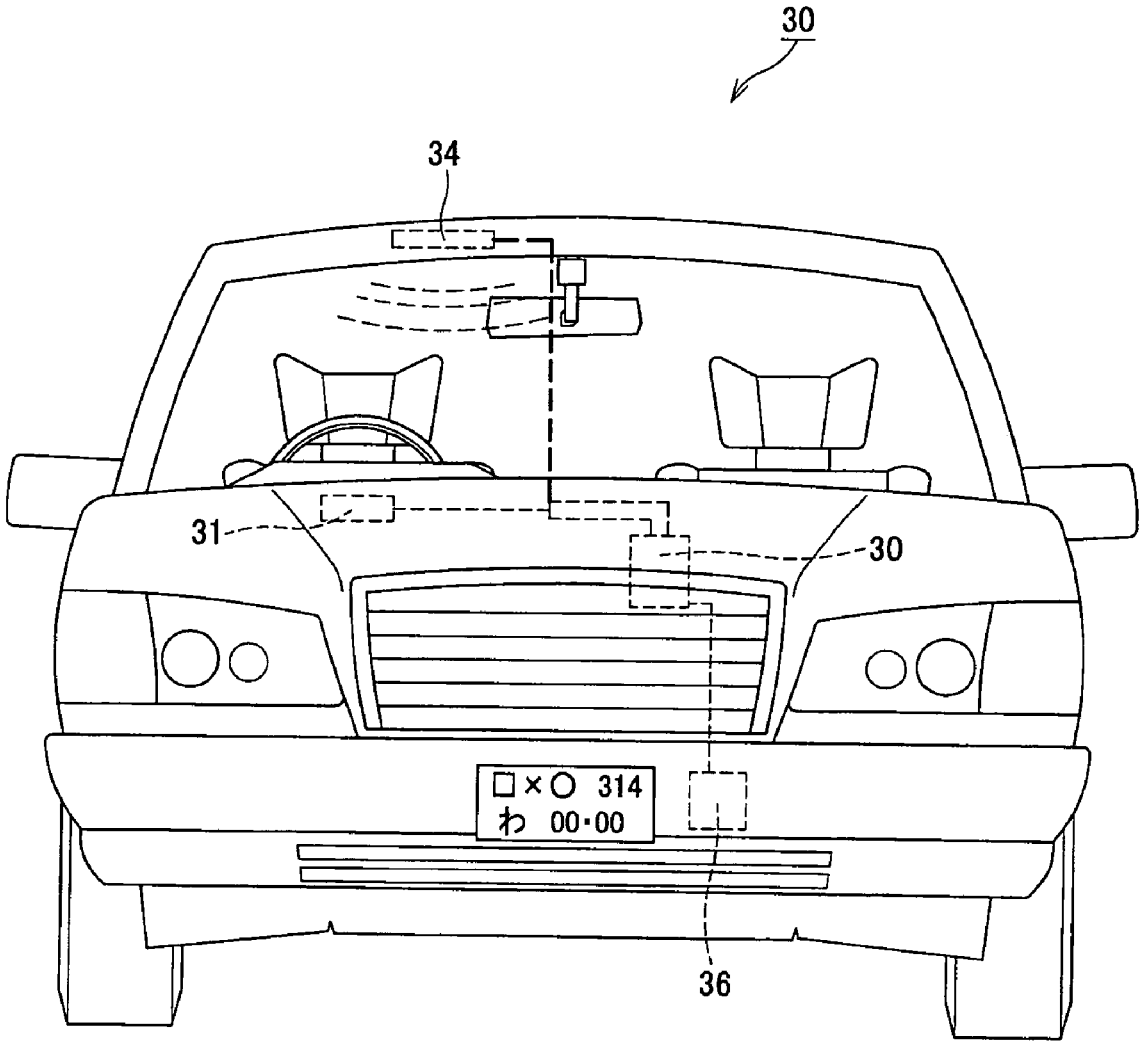
FIG. 5 is a view schematically explaining a car having the signal generating device.
Figure 6:
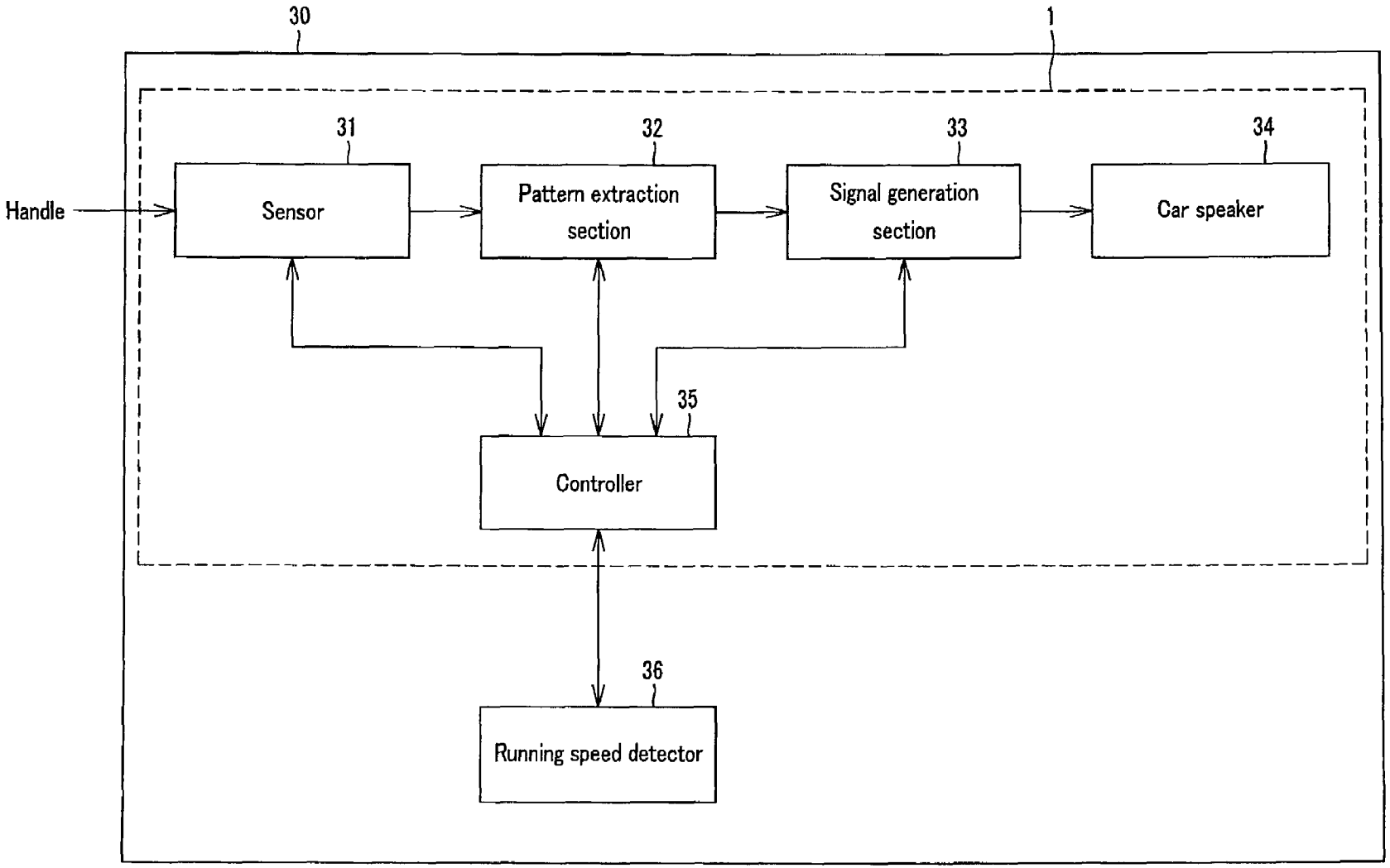
FIG. 6 is a configuration diagram for explaining an excessive speed warning apparatus having the signal generating device.

As shown in FIG. 5, in the excessive speed alarm apparatus 30, information related to the running speed detected by the running speed detector 36 attached to the axle or the like is sent to the controller 35. When running speed exceeds a predetermined value, the controller 35 generates an alarm sound obtained from a signal partly synchronous and partly asynchronous with the minute vibration corresponding to "structure allowance" of the handle that has been detected by the pattern extraction section 32 and gives warning to the driver about the excessive driving speed by outputting the alarm sound through the car speaker 34.

An alarm sound based on the signal shown in FIG. 2C, that is, the signal partly synchronous with the own steering action (handle wobble) and partly asynchronous with it due to insertion of extra signal parts, or another alarm sound based on the signal shown in FIG. 2D, that is, the signal partly synchronous with the own steering action (handle wobble) and partly asynchronous with it due to removal of some parts from the original signal is presented to the driver.

Figure 7:
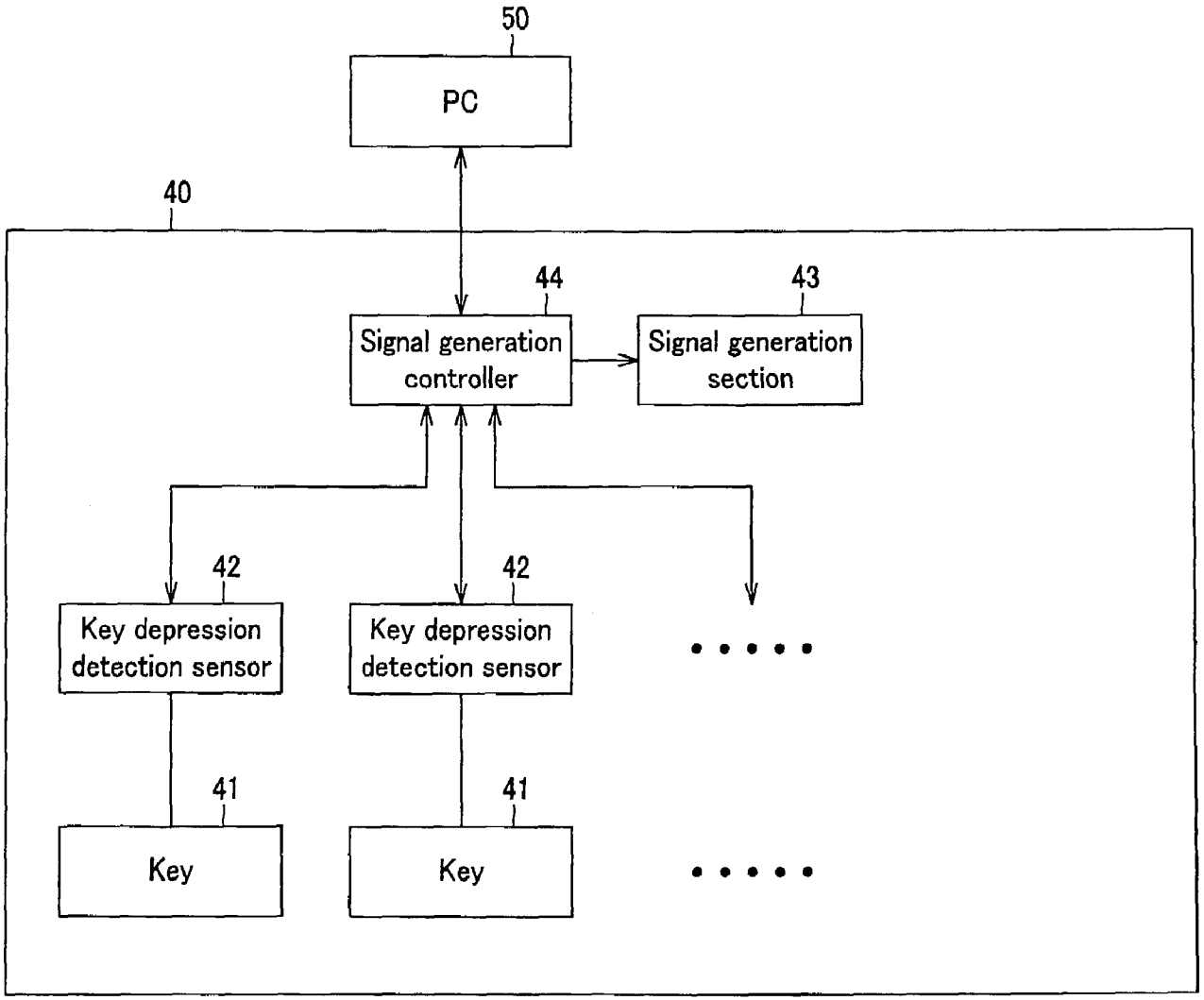
FIG. 7 is a configuration diagram for explaining a keyboard having the signal generating device.

Next, an example in which the signal generating device 1 is applied to a keyboard of a personal computer will be described with reference to FIG. 7.

A keyboard 40 is connected to a personal computer (PC) 50. As shown in FIG. 7, the keyboard 40 includes a key depression detection sensor 42 that is provided for each key 41 and detects the depression operation of the user, a signal generation section 43 that generates a signal based on the key depression pattern detected by the key depression detection sensors 42, and a controller 44 that controls the above components. When an event occurring in the PC relates to an error, an alarm sound based on the signal shown in FIG. 2C, 2D, or 2E is presented to the user. When an event occurring in the PC relates to e-mail arrival, a notification sound based on the signal shown in FIG. 2B is presented to the user.

In this example, the generated signal is output, as sound, from a voice output section of the PC. The key depression detection sensor 42 may be identical to the key itself and it is not necessary to independently provide a sensor that detects the key depression.

According to the signal generating device 1, which has been described as the embodiment of the present invention, a signal synchronous with the motion of the user's body or the motion of the electronic apparatus or mechanical apparatus that the user operates is generated. The generated signal is synchronous with the motion of the user. Thus, when a notification sound is created from the signal, the user's attention is more likely to be attracted as compared to the case where the user hears a sound having nothing to do with the own motion (e.g., so called an ordinary alarm sound). It is therefore possible for the user to be reliably aware of the alarm or notification even in a noisy environment, in a situation where the user concentrates on the task, or during exercise. In particular, the more the user concentrates on the task or exercise, the more the user is likely to be aware of the sound emitted in synchronization with the own motion, increasing the effect of allowing the user to perceive the alarm or notification.

On the other hand, when a sound partly synchronous and partly asynchronous with the motion of the user's body or the motion of the electronic apparatus or mechanical apparatus that the user operates is generated, the user senses a discomfort at the sound asynchronous with the motion. Therefore, the user's attention is more likely to be attracted. As a result, it is possible for the user to be reliably aware of the alarm or notification even in a noisy environment, in a situation where the user concentrates on the task, or during exercise.

The important point is that the user feels more strongly against the sound partly synchronous and partly asynchronous with the motion than the sound entirely asynchronous with the motion. Therefore, the former is more suitable for inviting attention. In the present embodiment, therefore, the signal synchronous with the motion of the user is used for a mere "notification" and the signal partly synchronous and partly asynchronous with the motion of the user is used for a notification with urgency, that is, a "warning".

The warning sound or notification sound based on the warning signal or notification signal generated by the signal generating device 1 can be a sound that is not perceived by the persons surrounding the user that operates the electronic apparatus or mechanical apparatus or the persons doing other tasks. The waning or notification sound is merely a random rhythm or meaningless sound for the persons other than the user, so that the sound does not disturb other persons surrounding the user, in other words, additional noise is not generated.

The present invention is not limited to the above-described embodiment, and can be variously modified without departing from the spirit and scope of the invention. For example, in the signal generated by the signal generation section 13 shown in FIG. 2, the configuration is allowable in which the feature quantity is synchronous with the motion of the user and the tone, volume, or interval of the sound is partly modulated. Further, assume that the signal generating device 1 is applied to an input operation of an electronic apparatus or the like. In this case, if the object that always emits a sound suddenly stops a sound production, or emits a sound irregularly, the user senses discomfort. In view of the above point it is possible to notify the user of an event occurrence by partly muting the operational sound.

Further, in the above embodiment, "event to be notified" is classified into "warning" and "notification" in which the object and urgency of the event notification differ between the two, and the signal synchronous with the motion is used for "notification" and signal asynchronous with the motion is used for "warning". However, types of the signal to be used are not limited to this and the user may select an adequate signal from the signals shown in FIG. 2A to 2D.

The signal generating device according to the present invention can be incorporated in an electronic apparatus that is operated by the user, such as a mobile phone, a personal computer or a portable information processing terminal, or a mechanical apparatus such as a car, an airplane, or a manufacturing machine. It is possible to incorporate the signal generating device in any apparatus as long as it can continuously receive the operation and can detect the feature quantity of the motion of the user, or it can detect the feature quantity of the motion of the apparatus (machine) itself.

It should be understood by those skilled in the art that various modifications, combinations, sub-combinations and alterations may occur depending on design requirements and other factors insofar as they are within the scope of the appended claims or the equivalents thereof.

What is claimed is:

1. A signal generating device comprising:

detection means for detecting a motion of a user of the device;

feature extraction means for extracting a feature quantity from a value detected by the detection means;

signal generation means for generating a signal corresponding to the feature quantity extracted by the feature extraction means; and presentation means for presenting a generated signal from the signal generation means to the user.

2. The signal generating device according to claim 1, wherein the signal generated by the signal generation means is synchronous with the feature quantity extracted by the feature extraction means.

3. The signal generating device according to claim 2, wherein the signal generation means inserts a signal at regular timings into the generated signal.

4. The signal generating device according to claim 2, wherein the signal generation means removes a signal portion at regular timings from the generated signal.

5. The signal generating device according to claim 2, wherein the signal generation means inserts a signal at irregular timings into the generated signal.

6. The signal generating device according to claim 2, wherein the signal generation means removes a signal portion at irregular timings from the generated signal.

7. The signal generating device according to claim 1, wherein the signal generated by the signal generation means is asynchronous with the feature quantity extracted by the feature extraction means.

8. The signal generating device according to claim 1, wherein the signal generated by the signal generation means is partly synchronous and partly asynchronous with the feature quantity extracted by the feature extraction means.

9. The signal generating device according to claim 1, wherein the detection means is attached to a part of the user's body, the feature extraction means detects the feature quantity while the user is walking or running, and the signal generated by the signal generation means is synchronous and/or asynchronous with the feature quantity extracted by the feature extraction means.

10. The signal generating device according to claim 1, wherein the detection means is attached to a part of the user's body part that operates a mechanical apparatus having the signal generating device mounted thereto.

11. The signal generating device according to claim 1, wherein the detection means is provided in an operation input section of a mechanical apparatus having the signal generating device mounted thereto, for which the user performs an input operation.

12. The signal generating device according to claim 1, wherein the presentation means light emitting means.

13. The signal generating device according to claim 1, wherein the presentation means comprises voice output means.

14. The signal generating device according to claim 1, wherein the presentation means comprises vibration generation means.

15. A signal generating method comprising:

a detection step of detecting a motion of a user and producing a corresponding value;

a feature extraction step of extracting a motion feature quantity from the value detected in the detection step;

a signal generation step of generating a signal corresponding to the motion feature quantity extracted in the feature extraction step; and a presentation step of presenting the signal generated in the signal generation step to the user.

16. A mechanical apparatus having operation input means for which a user performs an input operation and control means for controlling an operation of the mechanical apparatus based on an instruction from the user that has been input through the operation input means, the apparatus comprising:

detection means for detecting a motion of the user;

feature extraction means for extracting a feature quantity from a value detected by the detection means;

signal generation means for generating a signal corresponding to the feature quantity extracted by the feature extraction means; and presentation means for presenting the signal generated by the signal generation means to the user, wherein when an event to be notified to the user occurs, the control means causes the presentation means to present the occurrence of the event to the user using the signal generated by the signal generation means.

17. The mechanical apparatus according to claim 16, wherein the detection means is provided in the operation input means.

18. The mechanical apparatus according to claim 16, wherein the signal generated by the signal generation means is synchronous with the feature quantity extracted by the feature extraction means.

19. The mechanical apparatus according to claim 16, wherein the signal generated by the signal generation means is asynchronous with the feature quantity extracted by the feature extraction means.

20. The mechanical apparatus according to claim 16, wherein the signal generated by the signal generation means is partly synchronous and partly asynchronous with the feature quantity extracted by the feature extraction means.

21. A signal generating device comprising:

a detection section detecting a motion of a user of the device;

a feature extraction section extracting a feature quantity from a value detected by the detection section;

a signal generation section generating a signal corresponding to the feature quantity extracted by the feature extraction section; and a presentation section presenting the signal generated by the signal generation section to the user.

22. A mechanical apparatus having an operation input section for which a user performs an input operation and a controller that controls an operation of the mechanical apparatus based on an instruction from the user that has been input through the operation input section, the apparatus comprising:

a detection section detecting a motion of the user;

a feature extraction section extracting a feature quantity from a value detected by the detection section;

a signal generation section generating a signal corresponding to the feature quantity extracted by the feature extraction section; and a presentation section presenting the signal generated by the signal generation section to the user, wherein when an event to be notified to the user occurs, the controller causes the presentation section to present the occurrence of the event to the user using the signal generated by the signal generation section.

* * * * *